United States Patent [19]

Kratochvil

[11] 3,955,917

[45] May 11, 1976

[54] KILNS

[75] Inventor: Miroslav Kratochvil, Bondi Junction, Australia

[73] Assignee: R.M.C. Transport (New South Wales) Pty. Limited, Sydney, Australia

[22] Filed: Mar. 25, 1975

[21] Appl. No.: 561,678

Related U.S. Application Data

[63] Continuation-in-part of Ser. No. 431,879, Jan. 9, 1974, abandoned.

[52] U.S. Cl. ..... 432/106; 432/109

[51] Int. Cl.[2] ..... F27B 7/02

[58] Field of Search ..... 432/103–106, 109, 432/111, 10, 14; 34/136, 135

[56] References Cited

UNITED STATES PATENTS

| | | | |
|---|---|---|---|
| 1,350,750 | 8/1920 | Truesdell et al. | 432/106 |
| 1,734,417 | 11/1929 | Briggs | 432/109 |
| 1,914,462 | 6/1933 | Ronne | 432/106 |
| 2,049,734 | 8/1936 | Fasting | 432/109 |
| 2,590,090 | 3/1952 | DeVaney | 432/106 |
| 2,823,910 | 2/1958 | Ravasio | 432/106 |
| 3,188,751 | 6/1965 | Sutton | 34/136 |

FOREIGN PATENTS OR APPLICATIONS

| | | | |
|---|---|---|---|
| 833,127 | 7/1949 | Germany | 432/109 |

*Primary Examiner*—John J. Camby
*Assistant Examiner*—Henry C. Yuen
*Attorney, Agent, or Firm*—George F. Smyth

[57] ABSTRACT

A rotating kiln having two rotating cylindrical chambers, these chambers having colinear axes which slope below the horizontal from the upper or loading end of the first chamber. The material to be processed into light-weight aggregate is introduced to the kiln at the upper end of the first chamber which is of narrower diameter than the second chamber. The lower end of the first chamber unites with the upper end of the second chamber providing an annular inner face for the second chamber.

13 Claims, 3 Drawing Figures

KILNS

This application is a continuation-in-part of my prior copending application Ser. No. 431,879, filed Jan. 9, 1974, and now abandoned.

This invention relates to kilns and, more particularly to rotating kilns used to produce lightweight aggregates from materials such as shale, clay and mud.

In the past such kilns have incorporated a single, long, substantially cylindrical, rotating chamber. Material for processing has been fed into such a chamber and subjected to heating by known means. Such known kilns, because of their lengths occupy considerable land areas and the processing of materials occupies a considerable period of time. It is an object of this invention to ameliorate the disadvantages of such known kilns.

In one general form the invention provides a rotating kiln comprising first and second rotating chambers, said chambers being substantially cylindrical and having colinear axes sloping below the horizontal from the top end of said first chamber at which material for processing is introduced to said chambers, said second chamber being affixed to the lower end of said first chamber and being of greater diameter than said first chamber.

This invention further provides a rotating kiln comprising the first and second chambers described above, wherein the face of said second chamber remote from said first chamber is open, and rotates adjacent a fixed end wall, and burner means directing a burning mixture at material to be treated in the lower part of said second chamber so that said burning mixture strikes said material before said mixture is fully burnt. A recess may be provided in said end wall to allow processed material to escape between said open face of said second chamber and said end wall.

Burner means provided in said end wall may comprise a single burner directed towards the material to be treated in the lower part of said second chamber, or may comprise a horizontally mounted burner in combination with a deflector adapted to deflect the burning mixture in the required direction.

It is preferred that the burning mixture is directed to strike said material before the mixture is completely burnt in order to create a reducing and/or carbonizing atmosphere as the burning mixture strikes said material. This in the drawings burner 14 is directed towards that part of the rotating second chamber at an angle to direct the flame from the burner at the approximate center of the material being treated. It is required in this preferred form that the gases from the burner should strike the material concerned while those gases are not completely combusted and before the gases commence to rotate in the kiln, whereby all the material under processing is enveloped in gases which are not completely combusted. A similar result may be achieved by use of a burner disposed in the end wall in combination with a deflector attached to the end wall.

Creation of such a carbonizing atmosphere is further enhanced in a preferred form of this invention by the provision in said end wall of an inlet through which additional combustible material such as coal-plant washery refuse may be introduced. The introduction of such additional combustible material assists to create the required reducing and/or carbonizing atmosphere without reducing the flame temperature.

It is further preferred that a plurality of blades of refractory material be provided in the lower end of said first chamber adjacent the junction of the first and second chambers. Such blades are fixed to the inner cylindrical wall of said first chamber and together form a rotating fan when said chambers rotate. The provision of said fan is useful for at least two reasons. Firstly, the annular wall of the second chamber fixed to the lower end of the first chamber provides considerable radiation back of heat from this wall into the second chamber. The provision of a bladed fan as described further enhances this radiation of heat back into the second chamber, thus allowing the entire kiln to be shorter than if no such bladed fan were provided, and consequently cheaper to construct.

Secondly, the provision of such bladed fan enhances rotation of gases leaving the second chamber. Such gases are first rotated by the revolving motion of the second chamber as and after the combustible mixture strikes the material on the floor of the second chamber. It is desirable to have such gases rotate in said first chamber so that heat from said gases might more readily be absorbed by the walls of the first chamber and by material proceeding down said first chamber.

A fixed third chamber may be provided at the top end of the first chamber. Gases leaving the first chamber may still carry some unburned carbon monoxide. The third chamber is therefore provided with a pilot burner and also a spray device through which either water or air may be sprayed into said third chamber. If gases containing carbon monoxide entering the third chamber from the first chamber are sufficiently hot, air is introduced into the third chamber to ignite said gases and burn off the unburned carbon monoxide. If such gases are not sufficiently hot so as to be self-igniting when mixed with air, heat is introduced to the third chamber from the burner to ignite said gases and burn off the unburnt carbon monoxide. Where there is little or no carbon monoxide in the gases escaping from the first into the third chamber but it is required to cool the gases, water is sprayed into the third chamber from the spray device.

Flue gases leaving the third chamber are put through a heat exchanger in a storage bin wherein material to be fed into the first chamber is housed.

It has been found that processing material in a rotating kiln according to this invention allows considerable advantage in the subjecting of particles of the material being processed, before bloating of those particles, to rapid temperature rise as the particles move from the first to the second kiln. It is estimated that where particles leave the first kiln at a temperature of 800°C. they enter the second chamber and are therein immediately exposed to a temperature of approximately 1150°C. Because of this exposure to such a considerably higher temperature in the second chamber a sealing "skin" is formed around lumps of aggregate, which skin prevents escape of gas from within individual lumps during bloating. This results in an aggregate of improved properties, one of which is a greater resistance to water absorption and higher strength, since the surface is crack free.

It is well known to a man skilled in the art that material rotating in rotating kilns is subjected to a self-grinding process which reduces the diameters of the lumps of the materials and results in production of a certain quantity of dust which cannot be processed. However, when a rotating kiln according to this invention is used there is considerably less abrasion to the particles in the first chamber than in conventional kilns since this first chamber is of less diameter than in known kilns. There is, consequently, less dusting of the processing material which results in less loss of material than in conventional large diameter single chamber kilns.

Because the great proportion of the processing of the material occurs in the large diameter second chamber and because this chamber is of considerably less volume than conventional chambers of rotating kilns, there is a considerable energy saving in using a kiln according to this invention. This energy saving is considerably enhanced by use of the radiating wall, shown at 17 in FIG. 1 of the drawings and of the reflecting fan blades shown at 18 in FIG. 1 since back radiation from the wall and the fan retains the temperature in the second chamber at a sufficient degree to maintain full combustion therein.

It has further been discovered that in using a kiln according to this invention, materials which would normally never bloat in conventional kilns, do bloat. The reason for this appears to be the carbonizing effect on the material by partially burned combustion gases after accelerated heating of the aggregate lumps as they enter the large diameter second chamber.

By way of example only, one embodiment of a rotating kiln according to this invention is described with reference to the accompanying drawings wherein.

Figures 1, 2:
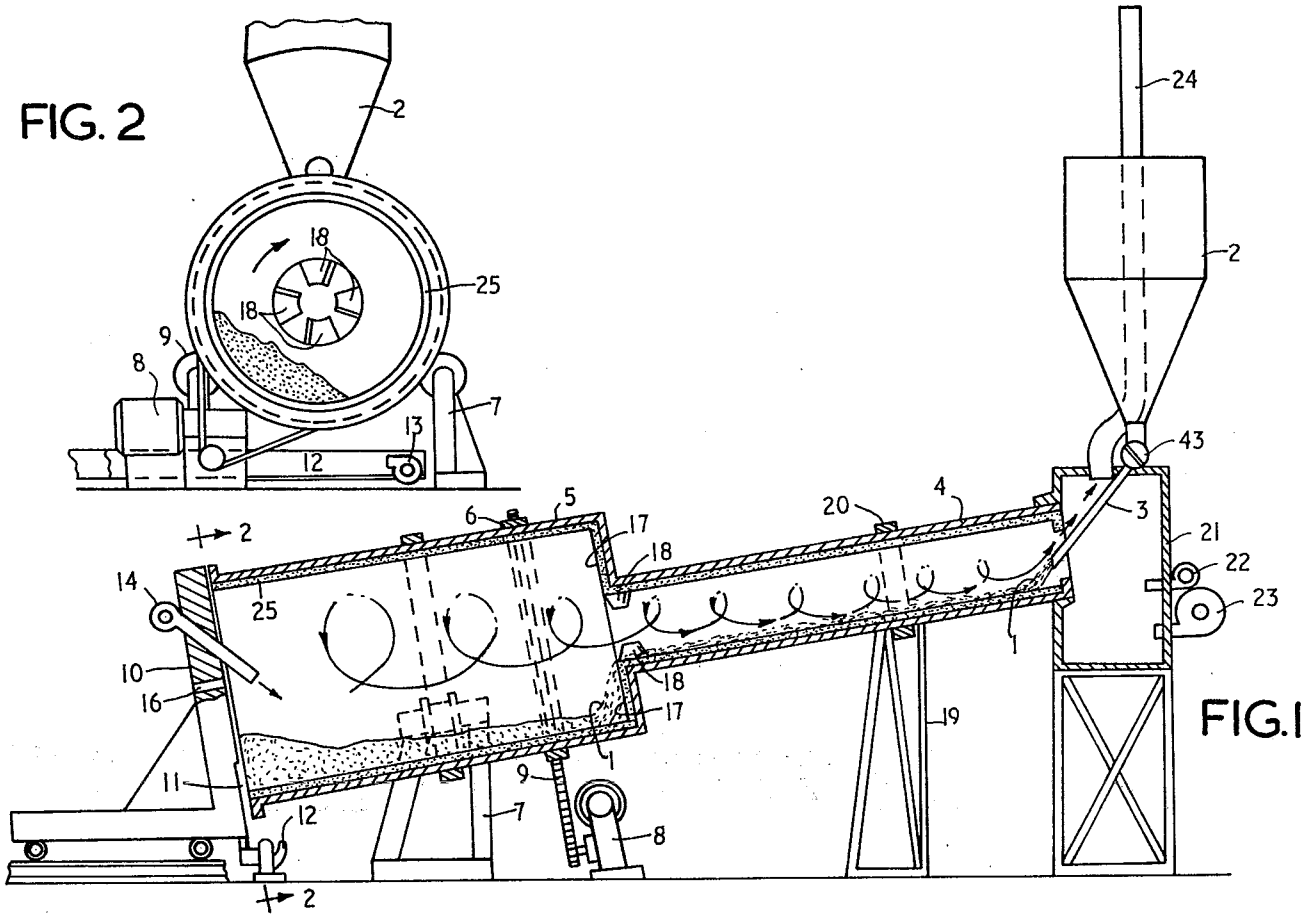
FIG. 1 is a part fragmentary sectional view in the vertical plane of a rotating kiln according to this invention.
FIG. 2 is a section of the line 2—2 of FIG. 1.

In the drawings, material 1 is introduced into storage bin 2 and is subjected to heating therein. Heated material 1 is then fed through chute 3 into first rotating chamber 4. Feeding valve 43 is provided to allow a constant feed of material 1 into chamber 4. Chamber 4 is substantially cylindrical and its axis slopes below the horizontal from chute 3 to allow material 1 to gravitate towards and into second substantially cylindrical rotating chamber 5. Chamber 5 has a larger diameter than chamber 4 and the axes of chambers 4 and 5 are colinear. Chamber 4 is supported on stand 19 by annular support ring 20. Further annular support rings 6 are provided to support second chamber 5 which is also supported by stand 7. Motor 8 drives chain 9 which operates to rotate chambers 4 and 5 at required speed.

Rotation of chamber 4 further assists to move material1 downwards into chamber 5. The major part of the processing of material 1 occurs in second chamber 5.

Chambers 4 and 5 have outer walls of mild steel and are internally lined with refractory material 25. Chamber 5 also has a reflecting wall 17 vertical to outer cylindrical wall of chamber 4. Material processed in chambers 4 and 5 escapes over refractory lining 25 into a recess 11 in end wall 10. Processed material falls into inclined trough 12 where it is cooled by air from blower fan 13 and collected as it falls from trough 12.

Chamber 5 rotates adjacent inclined fixed end wall 10. Mounted in end wall 10 is a burner 14 angled so that a stream of partially burnt mixture is directed at the lower part of the rotating wall of chamber 5 on which the material to be treated is situated.

After the burning mixture strikes the material on wall of chamber 5, there is created a turbulent movement of combustible mixture in chamber 5.

The creation of a reducing and/or carbonizing atmosphere in chamber 5 is achieved by deflecting the burning mixture from burner 14 so as to strike material to be treated before the mixture is completely burnt. To further assist in the creation of reducing conditions in chamber 5 there is provided in end wall 10 an inlet 16 through which any combustible material is introduced to chamber 5. By introducing such combustible material into chamber 5 it is possible to create a reducing atmosphere in chamber 5 without lowering the flame temperature of the combustible mixture proceeding from burner 14.

Reflection and radiation of heat from radiating wall 17 back into chamber 5 retains a temperature in chamber 5 of sufficient degree to maintain full combustion therein.

As illustrated in FIG. 1, the diameter of the chamber 5 is substantially greater than the diameter of the chamber 4. Accordingly, the area of the wall 17 is substantial with respect to the cross sectional area of the chamber 4. Preferably, the wall 17 has a substantially annular configuration as shown in FIG. 1 and preferably the area of the wall 17 is at least equal to the cross sectional area of the chamber 4. Due to the substantial area of wall 17 with respect to the cross sectional area of chamber 4, the wall 17 functions to reflect a substantial quantity of the heat radiating from chamber 5 back into that chamber. This serves to maintain chamber 5 at a substantially higher temperature than chamber 4.

Further reflection of heat back into chamber 5 is achieved by provision of blades 18 of refractory material which are affixed to and extend from the cylindrical wall of chamber 4 at a position adjacent the reflecting wall 17 of chamber 5. The blades 18 may have any shape so long as they function in their intended manner to reflect heat back into the chamber 5, to assist in providing rotational movement to combustion or burnt gases as the gases move from chamber 5 into chamber 4, and to permit the material 1 to move from chamber 4 into chamber 5. Thus, the blades 18 may be positioned at any convenient angle with respect to the axis of the chamber 4 so long as the blades are not positioned at a 90° angle with respect to the axis of the chamber 4. If positioned at a 90° angle to the axis of chamber 4, the blades 18 would interfere with the passage of the material 1 from chamber 4 into chamber 5 and also would not be effective in imparting rotational movement to the gases passing from chamber 5 into chamber 4.

As gases of the burnt mixture enter and proceed up chamber 4 they serve to commence the processing of the material 1. The gases leaving chamber 4 may include some still unburned carbon monoxide. A fixed chamber 21 is provided adjacent the upper end of chamber 4 and a pilot burner 22 and spray device 23 are mounted through one wall of the chamber 21. When gases entering chamber 21 from chamber 4 contain undesirable quantities of unburned carbon monoxide and are of a sufficient temperature to be self-igniting when mixed with air, such air is introduced to chamber 21 through spray device 23. When such gases entering chamber 21 are not of such sufficient temperature, heat is introduced to chamber 21 from burner 22 to burn off such unburned carbon monoxide. When gases entering chamber 21 from chamber 4 contain little or no carbon monoxide, water is sprayed into chamber 21 through the spray device 23 to cool said gases.

Gases exiting from the chamber 21 through flue 24 are also subjected to heat exchange in storage bin 2.

Figure 3:
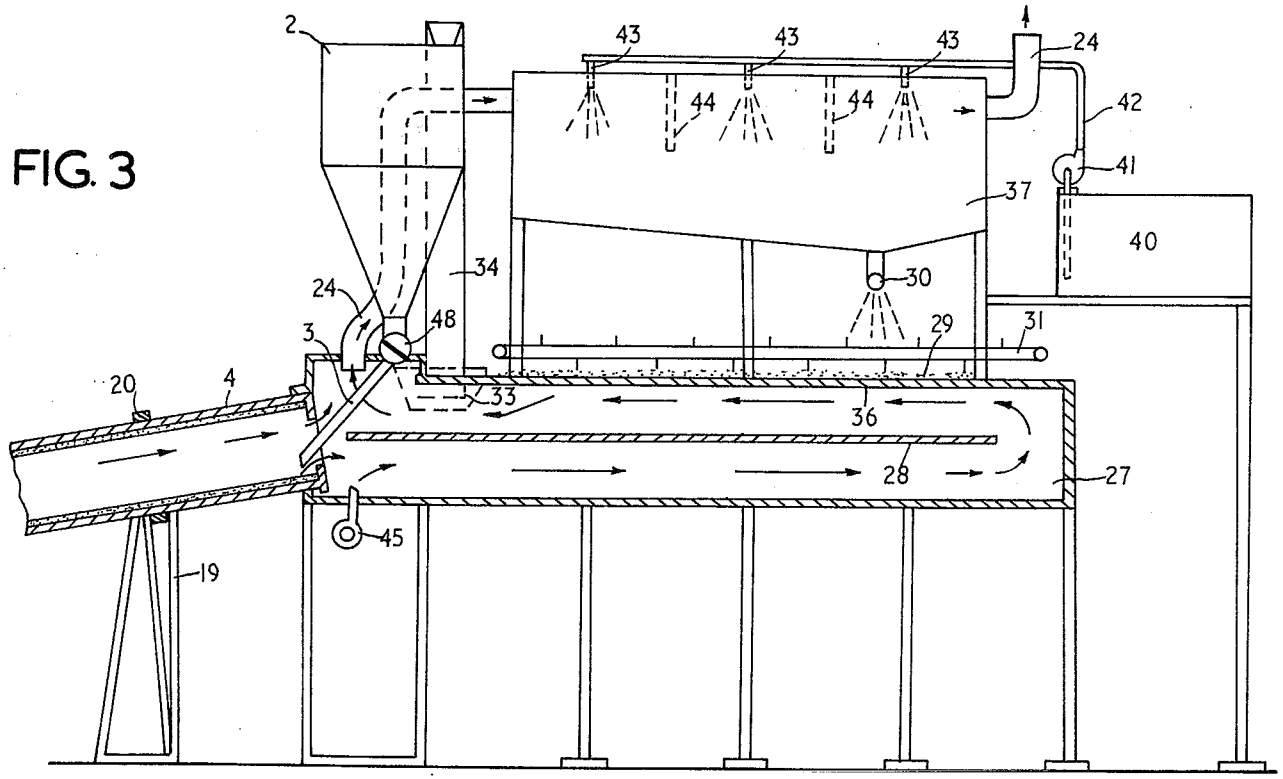
FIG. 3 is a section of the storage end of the kiln, showing an alternative arrangement used when the material treated is mud.

In the case where mud is being processed the alternate arrangement as indicated in FIG. 3 is appropriate. A large amount of heat energy must be used to evaporate water from mud before the mud is fed into chute 3. To accomplish this, a large collecting chamber 27 is provided adjacent the upper end of chamber 4. Gases entering the chamber 27 from chamber 4 are heated by a burning mixture supplied by a large combustor 45 and some of the gases proceed around a baffle 28 to heat a top wall 36 of the chamber 27, which top wall serves as a hot plate for partial drying of mud 29. Mud for processing is first stored in mud storage tanks 40 and is pumped by a pump 41 through a channel 42 to mud spray nozzles 43 from whence it is sprayed into mud vat 37. Mud vat 37 is provided with baffles 44. Hot gases entering the mud vat 37 from flue 24 circulate around the baffles 44. These hot gases commence the drying of the mud in vat 37. Further, gases entering the vat 37 may contain dust particles from previously processed materials. The mud in vat 37 serves to collect any such dust and to return collected dust through storage bin 2 for processing. Consequently, the gases exiting from vat 27 through the flue 24 are relatively clean. The mud proceeds from vat 37 through an outlet 30 to the top wall 36 of chamber 27.

A conveyor 31 scrapes the drying mud 29 from hot plate 36 into a hopper 33. An elevator 34 serves to raise the mud from hopper 33 into storage bin 2, from whence processing is commenced as previously described.

I claim:

1. A rotating kiln comprising:

a first rotating chamber having an upper end and a lower end;

a second rotating chamber having an upper end and a lower end;

said first and second chambers being substantially cylindrical and said chambers having colinear axes which slope downwardly toward the horizontal to provide gravity feed for material passing through said chambers;

said first chamber being positioned at a higher elevation than said second chamber;

means for the introduction of material to be processed into said upper end of said first chamber;

a closed connection defining an opening between said lower end of said first chamber and said upper end of said second chamber for the passage of material from said first chamber to said second chamber while excluding the entry of air through said closed connection into said chambers;

said second chamber having a diameter which is substantially greater than the diameter of said first chamber;

said second chamber having an upper end wall positioned about said closed connection between said first and second chambers;

said upper end wall defining an annular reflecting surface having a substantial area with respect to the opening formed by the closed connection between said first and second chambers;

burner means positioned to introduce combustible gases into the said second chamber in supplying heat to said second chamber, and said annular reflecting surface positioned in exposed relationship with respect to said burner means to reflect a substantial quantity of heat back into said second chamber, whereby said second chamber is maintained at a higher temperature than said first chamber such that material being treated undergoes a rapid temperature rise as the material moves from the first chamber into the second chamber.

2. The rotating kiln of claim 1 including:

said lower end of said second chamber being open;

a closure member positioned adjacent said lower open end to close said open end, and means in said closure member to permit the flow of processed material from said lower end of said second chamber.

3. The rotating kiln of claim 1 wherein:

said burner means is constructed to direct a flame downwardly against a bottom wall surface within said second chamber.

4. The rotating kiln of claim 1 including:

means to provide a reducing or carbonizing atmosphere within said second chamber.

5. The rotating kiln of claim 1 including:

a third chamber in flow communication with said upper end of said first chamber, and said third chamber including means to treat gases escaping from said first chamber.

6. The rotating kiln of claim 5 including:

means to transfer heat from gases leaving said third chamber to material to be fed to said first chamber for processing.

7. The rotating kiln of claim 1 including:

an extended collecting chamber having a material heating surface;

means to convey gases exiting from said upper end of said first chamber into heat exchange relation with said heating surface for heating material on said surface, and means to convey material from said heating surface to said first chamber for processing.

8. The rotating kiln of claim 7 including:

combustor means within said collecting chamber, and said combustor means supplying heat to said heating surface and supplying heat to said gases exiting from said upper end of said first chamber.

9. The rotating kiln of claim 8 including:

a mud vat;

means to convey gases exiting from said collecting chamber through said mud vat with said gases contacting the mud in said vat to remove dust from said gases, and means to transfer mud from said vat to said heating surface.

10. The rotating kiln of claim 1 wherein:

said annular reflecting surface has an area which is at least as large as the area of said opening formed by the closed connection between said first and second chambers.

11. The rotating kiln of claim 1 including a plurality of refractory blades;

said blades being positioned within said first chamber adjacent the lower end of said first chamber;

said blades extending inwardly from said chamber to partially block the opening between said first and second chambers; and said blades being shaped to impede the transfer of radiant energy from said second chamber through the opening into said first chamber by reflecting the heat from said second chamber back into said second chamber, and said blades being shaped to permit the passage of material from said first chamber through the opening into said second chamber.

12. The rotating kiln of claim 11 wherein:

said refractory blades are shaped to impart a rotational movement to hot gases passing from said second chamber through said closed connection into said first chamber, whereby the heat from said gases is more readily absorbed by the first chamber and by the material as it passes downwardly through said first chamber.

13. The rotating kiln of claim 11 wherein:

said annular reflecting surface has an area which is at least as large as the area of said opening formed by the closed connection between said first and second chambers.

* * * * *